US009903535B2

(12) United States Patent
Snyder et al.

(10) Patent No.: US 9,903,535 B2
(45) Date of Patent: Feb. 27, 2018

(54) CRYOGENIC LIQUID CONDITIONING AND DELIVERY SYSTEM

(71) Applicant: Green Buffalo Fuel, LLC, Tonawanda, NY (US)

(72) Inventors: Kenneth Leo Snyder, Hamburg, NY (US); Robert Francis Desjardins, Boston, NY (US); Nathaniel Eaton Allen, Buffalo, NY (US); James Joseph Donovan, Tonawanda, NY (US); Mark Ray Nuernberger, West Falls, NY (US); Peter Maurice Coleman, Eden, NY (US)

(73) Assignee: Green Buffalo Fuel, LLC, Tonawanda, NY (US)

( * ) Notice: Subject to any disclaimer, the term of this patent is extended or adjusted under 35 U.S.C. 154(b) by 314 days.

(21) Appl. No.: 14/721,211

(22) Filed: May 26, 2015

(65) Prior Publication Data

US 2015/0252947 A1 Sep. 10, 2015

Related U.S. Application Data

(62) Division of application No. 13/735,691, filed on Jan. 7, 2013, now abandoned.

(51) Int. Cl.
*F17C 7/02* (2006.01)
*F17C 7/04* (2006.01)
(Continued)

(52) U.S. Cl.
CPC ..... *F17C 7/04* (2013.01); *F17C 7/02* (2013.01); *F17C 13/025* (2013.01)

(58) Field of Classification Search
CPC ..... F17C 13/04; F17C 2205/0302; F17C 2205/0323; F17C 2205/0326;
(Continued)

(56) References Cited

U.S. PATENT DOCUMENTS 2,500,249 A * 3/1950 Hansen ..... F17C 7/04 122/32
2,525,807 A * 10/1950 Lane ..... F17C 13/02 137/247.33
(Continued)

FOREIGN PATENT DOCUMENTS

CA 2293774 A1 * 12/1998 ..... B23K 9/173
EP 1177401 6/2002
EP 1306604 2/2003

*Primary Examiner* — David Teitelbaum
*Assistant Examiner* — Erik Mendoza-Wilkenfel
(74) *Attorney, Agent, or Firm* — Hodgson Russ LLP

(57) ABSTRACT

A cryogenic liquid conditioning system with flow driven by head pressure of liquid contained in a cryogenic storage tank, and a cryogenic liquid delivery system with flow driven by pressure in the vapor space of the cryogenic storage tank. A heat exchanger, coupled to the cryogenic storage tank located below the liquid level of the tank, operates as a portion of both the conditioning system and delivery system. A piping system moves cryogenic liquid to the heat exchanger where it is vaporized, and then moves vaporized liquid to the vapor space of the cryogenic tank and an application. The piping system includes a controller and valve(s) for controlling flow through the system. A sensor for measuring the saturated pressure of cryogenic liquid is coupled to the storage tank or piping system, and is in communication with the flow controller.

8 Claims, 3 Drawing Sheets

(51) Int. Cl.

| | |
|---|---|
| ***F17C 9/02*** | (2006.01) |
| ***F17C 9/04*** | (2006.01) |
| ***F17C 13/00*** | (2006.01) |
| ***F17C 13/04*** | (2006.01) |
| ***F02M 21/00*** | (2006.01) |
| ***F02D 31/00*** | (2006.01) |
| ***F17C 13/02*** | (2006.01) |

(58) Field of Classification Search
CPC ..... F17C 2205/0338; F17C 2205/0388; F17C 2205/0394; F17C 13/0204; F17C 9/02; F17C 9/04; F17C 7/00; F17C 7/02; F17C 7/04; B60L 11/1896; F02D 31/007; F02D 31/008; F02D 31/009; F02D 33/003; F02D 35/0069; F02D 2200/0602; F02D 2200/0606; F02M 21/00; F02M 21/0209; F02M 21/023; F02M 21/0239
See application file for complete search history.

(56) References Cited

U.S. PATENT DOCUMENTS 2,551,501 A * 5/1951 Mitchell ..... F17C 7/04 122/452
3,097,498 A 7/1963 Williams
3,797,262 A 3/1974 Eigenbrod
3,797,263 A 3/1974 Shahir et al.
4,472,946 A 9/1984 Zwick
4,561,258 A 12/1985 Brodbeck et al.
4,947,651 A 8/1990 Neeser et al.
5,127,230 A 7/1992 Neeser et al.
5,163,409 A * 11/1992 Gustafson ..... F02D 19/0647 123/525
5,325,894 A 7/1994 Kooy et al.
5,373,700 A 12/1994 McIntosh
5,390,646 A * 2/1995 Swenson ..... F02B 29/0412 123/525
5,421,162 A 6/1995 Gustafson et al.
5,590,535 A 1/1997 Rhoades
5,682,750 A 11/1997 Preston et al.
5,771,946 A * 6/1998 Kooy ..... F17C 6/00 141/11
5,937,655 A 8/1999 Weiler et al.
6,044,647 A 4/2000 Drube et al.
6,125,637 A 10/2000 Bingham et al.
6,474,101 B1 11/2002 Quine et al.
6,505,469 B1 1/2003 Drube et al.
6,619,273 B2 9/2003 Bingham et al.
6,698,211 B2 3/2004 Gustafson
6,799,429 B2 10/2004 Drube et al.
6,953,028 B2 10/2005 Bingham et al.
7,044,113 B2 5/2006 Bingham et al.
7,069,730 B2 7/2006 Emmer et al.
7,131,278 B2 11/2006 Svensson et al.
7,144,228 B2 12/2006 Emmer et al.
7,293,418 B2 11/2007 Noble et al.
8,065,883 B2 11/2011 Pozivil
8,459,241 B2 6/2013 Dixon et al.
2003/0126867 A1* 7/2003 Drube ..... F17C 7/04 62/50.2
2007/0204631 A1 9/2007 Udischas et al.
2011/0070103 A1 3/2011 Allidieres
2011/0146605 A1 6/2011 Dixon et al.
2011/0314839 A1* 12/2011 Brook ..... F02M 21/06 62/49.1
2014/0007943 A1* 1/2014 MacKey ..... F17C 1/00 137/1

* cited by examiner

CRYOGENIC LIQUID CONDITIONING AND DELIVERY SYSTEM

BACKGROUND

This disclosure relates generally to a conditioning and delivery system for cryogenic liquid. The present disclosure is particularly adapted for, but not limited to, a vehicle-mounted tank for efficiently conditioning and delivering liquefied natural gas (LNG) to an engine. However, people skilled in the technology will understand that the present disclosure can be employed to condition and deliver other cryogenic liquids to a number of applications.

For the purpose of this application, cryogenic liquids include liquefied gases that boil at temperatures at or below −150° F. under normal atmospheric pressure. LNG is one example of a cryogenic liquid because it boils at −258° F. under normal atmospheric pressure. Because of this, most cryogenic storage tanks are of a double wall construction. An inner pressure vessel is typically supported within an outer vessel. Radiation shielding is usually placed in the space between the inner and outer vessels, and the space is placed under a high vacuum to provide effective insulation against heat transfer.

The goal of a cryogenic liquid delivery system is usually to provide pressurized, gaseous material to an application, such as an engine, from a cold liquefied store of such material; however, a given volume of liquid produces many times the volume of gas when the liquid is vaporized. Because of this, systems that provide high pressure gas to an application from a relatively low pressure liquid have been developed. In common practice today, there are two methods for transferring pressurized cryogenic liquid from a cryogenic tank to an application such as an engine.

The first method for transferring cryogenic liquid from a storage tank to an application is a simple "pressure fed system", which uses the pressure in the vapor space above the liquid in a storage tank to move cryogenic liquid into a vaporizer, where the liquid is heated to a pre-determined temperature suitable for use as a pressurized gas.

However, pressure in the vapor space above liquid in a storage tank must be sufficiently high to move liquid into the vaporizer. Because of this, a simple pressure fed system typically includes a system for "pressure building." Pressure building systems typically rely on gravity, and use the liquid head pressure of the cryogenic liquid to move the liquid into an additional heat exchanger, where the liquid is vaporized, and then returned to the vapor space of the tank, thereby raising the pressure in the vapor space of the tank. However, pressure building systems have several problems.

One problem with pressure building systems is vapor pressure drop when demand for liquid is too great. Thus, if liquid is withdrawn from the storage tank at a high rate, the vapor pressure may be lowered to an unacceptable value due to an increase in ullage space. The circulation of cryogenic liquid through the pressure building heat exchanger is typically unable to compensate for this pressure drop, since the rate of pressure increase through the pressure build system is typically less than the rate of pressure loss during the withdrawal of liquid.

Another problem with pressure building systems is that there may only be a small liquid depth available in the tank to generate liquid head pressure to drive a pressure building circuit. Pressure drop in the heat exchanger and piping components is typically large enough that the liquid head pressure in the tank cannot overcome the resistance to flow, resulting in low or no flow through the pressure building circuit, and therefore resulting in no pressure increase in the tank.

Still another problem with pressure build systems is "pressure collapse." Pressure collapse is caused by any agitation to the cryogenic tank, which causes condensation of vaporized liquid, resulting in a "collapse" or loss of pressure created during pressure building. While pressure collapse is not a problem in stationary cryogenic tanks, it is a major problem in mobile cryogenic tanks, such as those on vehicles.

Lastly, adding a pressure build system to a cryogenic liquid delivery system requires the entire system to contain two separate heat exchangers; the first is used in a pressure building system, and the second is the vaporizer used to supply pressurized gas to an application. Thus there are numerous fittings and connectors required to join these components, each of which is a potential failure point, compromising the reliability of the system.

One way of dealing with the many problems of pressure build systems, is to pump cryogenic liquid with an elevated saturated pressure into the tank. Saturated pressure is the pressure exerted by a vapor in thermodynamic equilibrium with its condensed phases at a given temperature in a closed system. The saturated pressure of any substance increases non-linearly with temperature. Thus, cryogenic liquid with an elevated saturated pressure is created by elevating the saturated temperature of cryogenic liquid. This "warmed" cryogenic liquid, with an elevated saturated pressure is known as "conditioned liquid." Conversely, "unconditioned liquid" has a relatively low saturated temperature and saturated pressure to conditioned liquid. If conditioned liquid is initially dispensed into the cryogenic tank, there is no need for a pressure build system because the pressure of the cryogenic liquid in the tank cannot drop below its already elevated saturated pressure. However, raising the saturated pressure and temperature of a cryogenic liquid also causes the liquid to expand and become less dense. Thus, conditioned liquid contains less energy per volume than unconditioned liquid. For example, a natural gas powered vehicle will be able to run substantially farther on a given volume of colder, unconditioned liquid than it will on the same volume of warmer, conditioned liquid.

The second method for transferring cryogenic liquid from a storage tank to an application is a "pump system" which uses an external pump to physically pressurize the cryogenic liquid and move it to an application. The pump elevates the pressure of the liquid and delivers it to a heat exchanger known as a vaporizer, where the liquid is heated to a pre-determined temperature suitable for use as pressurized gas. An accumulator commonly follows the vaporizer thus allowing for a ready supply of gas to be stored at or near the approximate conditions required for the application. Because a pump is able to physically and rapidly condition cryogenic liquid, pump systems have no problems with pressure drop, and are able to utilize unconditioned liquid; however, pump systems create a number of new problems. A pump system requires a minimum of three outside components, namely a physically removed pump, heat exchanger, and accumulator. Numerous fittings and connectors are required to join together such a delivery system, each of which is a potential failure point or leak path compromising the reliability of such a system.

One way of dealing with such space and reliability issues is to incorporate a pump into a cryogenic storage tank. A concern with introducing a pump directly into a storage tank is that it may create a heat leak, thereby reducing the holding time of the cryogenic liquid. "Heat leak" is a concern because as the liquid heats up it expands, which increases the pressure within the storage tank. Once the pressure in the storage tank becomes too high, a pressure relief valve will typically open, releasing a portion of the tank's contents into the atmosphere or to a recovery system. "Holding time" describes the time span that a cryogenic liquid can be held inside a storage tank before the pressure relief valve opens. Because high heat leak leads to shorter holding times, heat leak in a storage tank will result in venting off a substantial portion of gaseous cryogenic material if the tank is required to hold the liquid for any appreciable amount of time. For example, if a storage tank used to store LNG fuel for use in a vehicle, any natural gas that is vented off because of heat leak is fuel that was paid for by the operator but never used, increasing cost. It is therefore important for storage tanks to have relatively long holding times. Cryogenic storage tanks with low heat leak and relatively long holding times are said to have good "thermal performance."

Historically, cryogenic liquid delivery systems either have the ability to effectively provide pressurized gas to an application at the expense of poor thermal performance, or good thermal performance with problems providing pressurized gas to an application. It is therefore desirable to provide a system that can effectively provide pressurized gas to an application, from unconditioned cryogenic liquid, to an application, and good thermal performance. Additionally it is desirable to provide a system with limited external components to ease installation on an application, and limit the number of potential failure points and leak paths.

SUMMARY OF THE INVENTION

According to the present disclosure, the foregoing and other objects and advantages are attained by a system for conditioning cryogenic liquid within a storage tank, and delivering vaporized cryogenic material to an application. The system includes at least one storage tank capable of storing cryogenic liquid at an initial pressure. At least one heat exchanger coupled to the at least one storage tank, positioned below the liquid level of the storage tank. The heat exchanger must have the ability to quickly and completely vaporize cryogenic liquid. A piping system coupled to the at least one storage tank and the at least one heat exchanger, and includes at least one path for cryogenic liquid to flow from the storage tank, at least one path for vaporized liquid to flow into the storage tank, and at least one path for vaporized liquid to flow to an application. The piping system must allow for sufficient flow, and have minimal flow restrictions.

If unconditioned cryogenic liquid is dispensed into the storage tank, head pressure will move the liquid through the heat exchanger, where it will be vaporized, and return to the vapor space of the tank. Any means of tank agitation will then cause condensation of the vaporized material, raising the saturated temperature and saturated pressure of the cryogenic liquid. Once the cryogenic liquid is saturated to a given pressure, pressure in the vapor space of the storage tank will move the liquid through the heat exchanger, where it will be vaporized, and delivered to an application.

It is therefore an advantage of the present disclosure to provide a system for conditioning cryogenic liquid within a cryogenic storage tank.

It is another advantage of the present disclosure to provide a simple pressure fed cryogenic liquid delivery system that is capable of providing pressurized gas to an application, from an unconditioned store of cryogenic liquid.

Additional objects, advantages and novel features of the disclosure will be set forth in part in the description which follows, and in part will become apparent to those skilled in the art upon examination of the following or may be learned by practice of the disclosure. The objects and advantages of the disclosure may be realized and attained by means of the instrumentalities and combinations particularly pointed out in the appended claims.

Reference will now be made to the exemplary embodiments illustrated, and specific language will be used herein to describe the same. It will nevertheless be understood that no limitation of the scope of the disclosure is thereby intended.

DETAILED DESCRIPTION OF PREFERRED EMBODIMENT(S)

Throughout the following description specific details are set forth in order to provide a more thorough understanding of the disclosure. However, the disclosure may be practiced without these particulars. In other instances, well known elements have not been showed or described in detail to avoid unnecessarily obscuring the present disclosure. Accordingly, the specification and drawings are to be regarded in an illustrative, rather than restrictive sense.

Generally, the subject disclosure relates to cryogenic liquid conditioning and delivery system, namely, a cryogenic tank assembly that incorporates a cryogenic storage tank, a combined liquid conditioning system to increase the saturated pressure of a cryogenic liquid within a storage tank, and a cryogenic liquid delivery system to deliver pressurized gas to an application such as a vehicular engine. The system described herein utilizes gravity or head pressure of the cryogenic liquid to move liquid through the conditioning system, and pressure in the vapor space of the tank to move cryogenic liquid through the delivery system.

Figure 1:
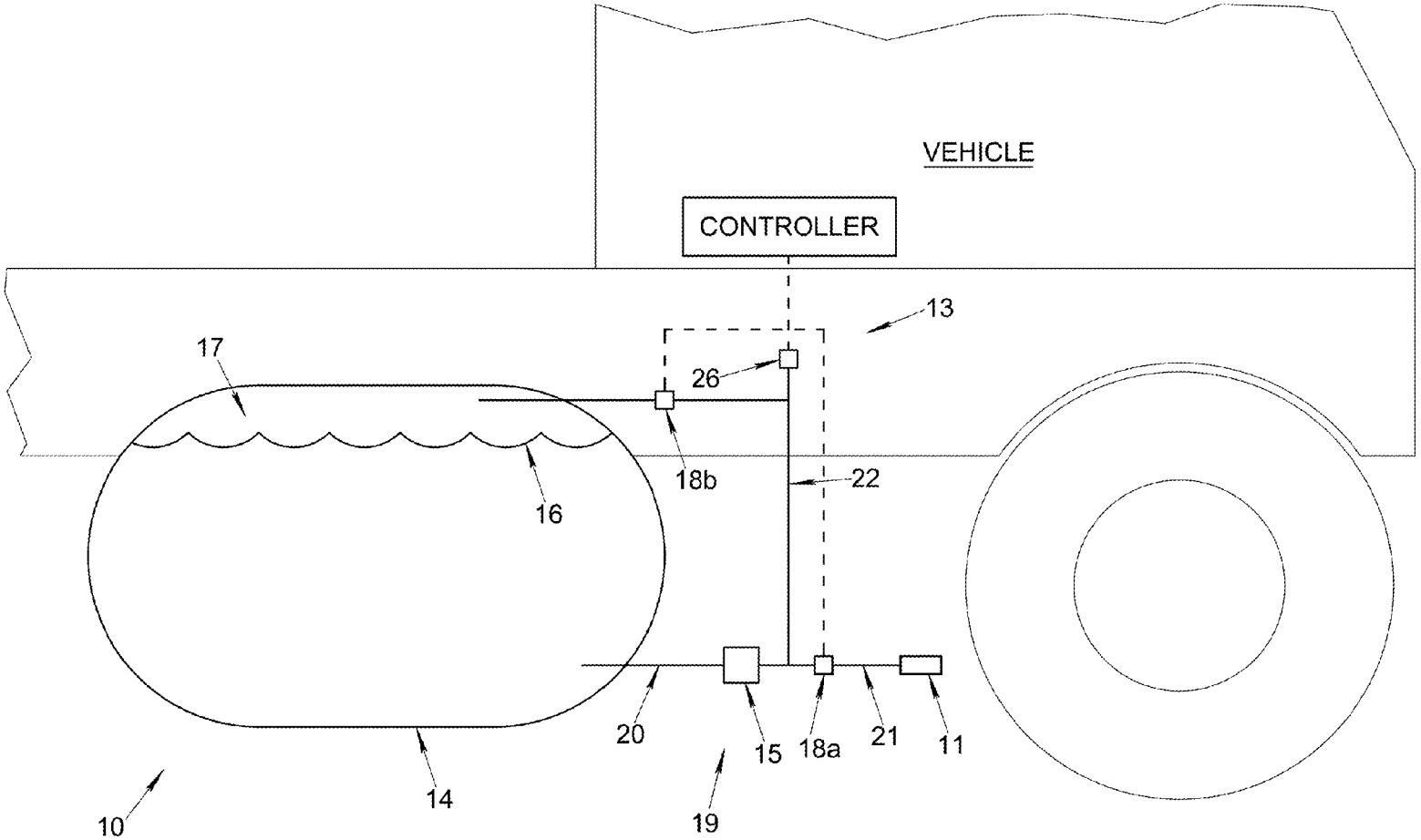
FIG. 1 is a schematic view of a cryogenic liquid conditioning and delivery system in accordance with a preferred embodiment of this disclosure.

As illustrated in FIG. 1, a cryogenic liquid delivery system, indicated generally at 10, is shown in an example implementation in accordance with the disclosure. The system includes a conditioning system, indicated generally at 13, to maintain saturated pressure in a storage tank 14 at a minimum acceptable saturated pressure to move cryogenic liquid through the delivery system 10. The system utilizes one heat exchanger to supply vaporized cryogenic liquid to both the vapor space of the storage tank, and to an application. The cryogenic liquid conditioning system described herein utilizes head pressure to move cryogenic liquid into a heat exchanger 15 located below the liquid level 16 of the storage tank. The cryogenic liquid is vaporized in the heat exchanger 15 and returned to the vapor space 17 of the tank. The cryogenic tank is then agitated, and the vaporized material condenses into the cryogenic liquid, thereby raising the saturated pressure of the cryogenic liquid within the storage tank. When the saturated pressure of the cryogenic liquid reaches a sufficient level, the pressure in the vapor space of the storage tank will move liquid through the heat exchanger 15, where it will be vaporized, and deliver the resulting pressurized gas to an application.

The schematic diagram in FIG. 1 shows the overall mechanical interaction and operation of a preferred embodiment of the present disclosure. The schematic diagram also illustrates the flow paths for liquid and vapor. It will be appreciated that alternate designs and types of cryogenic storage tanks can be utilized without materially affecting the operation of the disclosure described herein. The configuration in FIG. 1 can be utilized in a number of applications, including vehicles with an engine designed to be powered by cryogenic fuel, or as a retrofit to existing vehicles, such as those with a diesel-powered engine. The system will have at least one insulated storage tank 14 capable of receiving and containing cryogenic liquid. Typically, the tank 14 will be a vacuum insulated cryogenic storage tank designed to contain cryogenic liquid such as liquefied natural gas. For clarity, other devices that are commonly installed on cryogenic storage tanks such as pressure safety valves, liquid fill circuits, liquid level gauges, and pressure gauges are not displayed in FIG. 1 since they are immaterial to the operation of the disclosure.

A heat exchanger 15 is coupled to the storage tank, and located below the liquid level of the storage tank. A piping system 19 is coupled to the storage tank and heat exchanger 15. The piping system is sufficiently large to minimize pressure drop and resistance to flow. The piping system includes a liquid flow path 20 from the storage tank to the heat exchanger. The liquid flow path protrudes into the storage tank below the liquid level 16 of the tank, and may contain a means for maintaining a definitive liquid level within the piping system. The piping system further includes a vapor flow path 22 from the heat exchanger 15 to the vapor space 17 of the storage tank. The vapor flow path to the vapor space of the cryogenic tank contains a means for controlling vapor flow, such as a control valve 18*b*. Any type of control valve that, when open, would not increase flow restrictions, may be utilized without materially affecting the operation of this disclosure. The vapor flow path 22 to the vapor space 17 of the tank protrudes into the tank above the liquid level 16 of the tank. The piping system further includes a vapor flow path 21 from the heat exchanger to an application 11 that will utilize pressurized gas. The vapor flow path 21 to the application also contains a means for controlling vapor flow, such as a control valve 18*a*.

In typical operating conditions, the liquid in the cryogenic tank must be saturated at a given pressure, meaning that the liquid in the tank must be warmed to a desired temperature and pressure equilibrium before it will move to an application 11. Liquid that has been warmed and saturated at a given pressure is known as "conditioned liquid." If "unconditioned liquid" is dispensed into the storage tank, pressure head will move the liquid through the conditioning system 13 until it has been warmed to a desired temperature, and the cryogenic liquid is saturated at a given pressure.

To condition cryogenic liquid, head pressure within the storage tank causes liquid to flow into the liquid flow path 20, and then into the heat exchanger 15. There are minimal flow restrictions in the liquid flow path and heat exchanger which allow cryogenic liquid to move through the conditioning system 13 with minimal head pressure in the storage tank 14, and pressure drop in the heat exchanger 15. The heat exchanger causes the cold cryogenic liquid to become warm, and quickly and completely vaporize before exiting. Any type of heat exchanger may be used including, but not limited to, a device that utilizes a hot liquid solution such as engine coolant. The heat exchanger is located below the liquid level 16, and in close proximity to the storage tank, so as to minimize pressure drop and resistance to flow in the liquid flow path 20 and heat exchanger 15.

A means 26 for detecting the saturated pressure in the storage tank, communicates with the control valves 18*a* 18*b* in both vapor flow paths 21 22. Several measurement devices may be used including pressure sensors, thermocouples and other devices that are able to detect the saturated pressure of a cryogenic liquid. The device can communicate with the control valves in any way, including a programmable logic controller, mechanical relays, or solid state relays. When the saturated pressure of the cryogenic liquid in the storage tank is below a given level, the control valve 18*a* in the vapor flow path 21 to the application will close, and the control valve 18*b* in the vapor flow path 22 to the vapor space of the cryogenic tank will open. Liquid head pressure within the storage tank will then cause liquid to flow into the liquid flow path 20, and into the heat exchanger, where it will be vaporized. Vapor exiting the heat exchanger will then move through the conditioning system 13, and enter the vapor space of the cryogenic tank 17. Tank agitation will then cause the vapor to condense into the cryogenic liquid, raising the saturated pressure and temperature of the liquid within the storage tank 14.

Once the saturated pressure of the cryogenic liquid within the storage tank has reached a given level, the control valve 18*a* in the vapor flow path to the application will open, and the control valve 18*b* in the vapor flow path to the cryogenic tank will close. The pressure in the vapor space of the cryogenic tank will then cause liquid to flow into the liquid flow path 20, and into the heat exchanger 15, where it will be vaporized. Vapor exiting the heat exchanger will then move through the vapor flow path 21 to the application.

If the saturated pressure of the cryogenic liquid is sufficient for use in the application, but not elevated to a desired level, both control valves 18*a* 18*b* may be open simultaneously. When both valves are open, head pressure and pressure in the vapor space of the cryogenic tank will cause liquid to flow into the liquid flow path 20, and then into the heat exchanger 15, where it will be vaporized. Portions of the vapor exiting the heat exchanger will then move through both vapor flow paths 21 22 to the application 11 and the vapor space 17 of the cryogenic tank 14.

Figure 2:
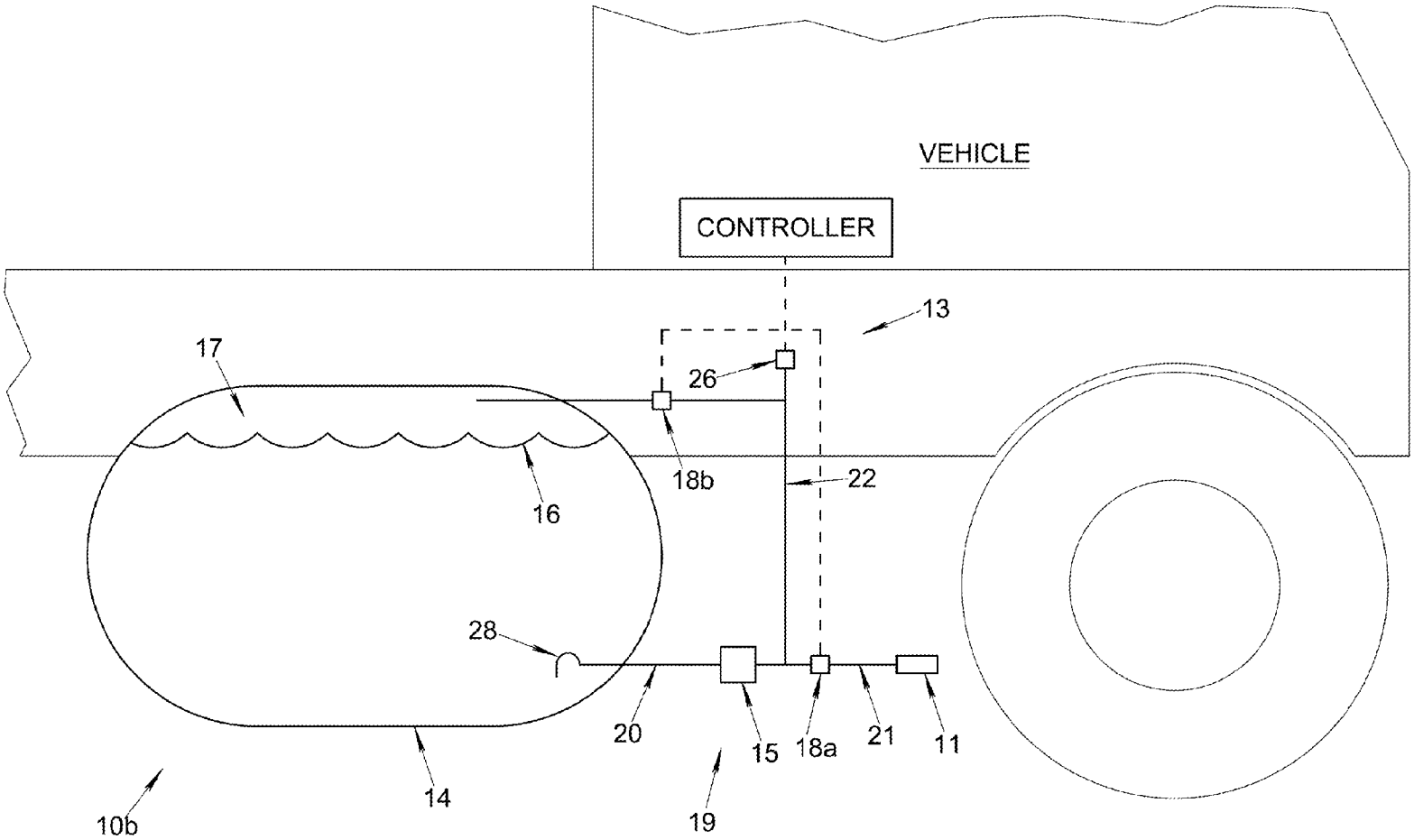
FIG. 2 is a schematic view of a cryogenic liquid conditioning and delivery system in accordance with a preferred embodiment of this disclosure.

Referring to FIG. 2, another system 10*b* is shown that is similar in most respects to that described above, but where the liquid flow path 20 contains a bend or "trap" 28 to maintain a definitive liquid level within the piping system.

Figure 3:
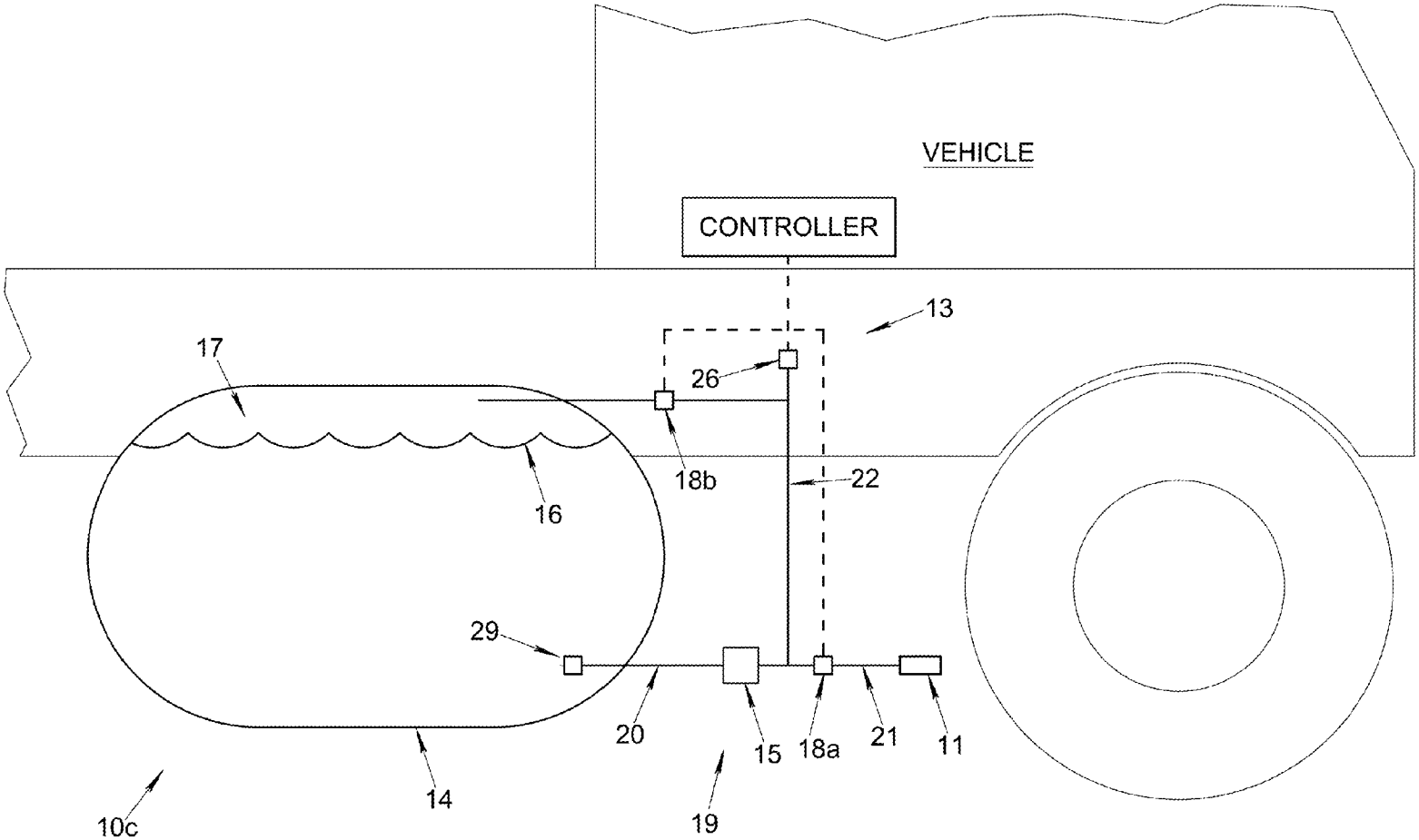
FIG. 3 is a schematic view of a cryogenic liquid conditioning and delivery system in accordance with a preferred embodiment of this disclosure.

Referring to FIG. 3, another system 10*c* is shown that is similar in most respects to that described above, but where the liquid flow path 20 contains a valve 29 to maintain a definitive liquid level within the piping system.

The cryogenic liquid conditioning system 13 and delivery system 10 may be enclosed in a shroud coupled to the cryogenic tank 14 to ease installation on an object such as a vehicle. However, failure to enclose the system will not materially affect the operation of this disclosure.

While the foregoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the disclosure. Accordingly, it is not intended that the disclosure be limited, except as by the claims set forth below.

What is claimed is:

1. A method of conditioning cryogenic liquid onboard a transport vehicle, the method comprising the steps of:

A) providing a conditioning system onboard the transport vehicle, the conditioning system comprising:

(a) an insulated storage tank capable of storing a liquid at a cryogenic temperature and an initial pressure, wherein the stored liquid defines a liquid level and a vapor space of the storage tank;

(b) a heat exchanger below the liquid level of the storage tank, wherein the heat exchanger converts cryogenic liquid to vapor;

(c) a piping system connecting the storage tank to the heat exchanger, the piping system including:

(i) a liquid flow path allowing cryogenic liquid to travel from the storage tank to the heat exchanger;

(ii) a first vapor flow path allowing vapor to travel from the heat exchanger to an application;

(iii) a second vapor flow path allowing vapor to travel from the heat exchanger to the vapor space of the storage tank; and (iv) at least one valve for selectively opening and closing the first vapor path and the second vapor path;

(d) means for measuring saturated pressure of the cryogenic liquid in the storage tank; and (e) means for controlling the at least one valve based on the measured saturated pressure;

B) controlling the at least one valve based on the measured saturated pressure such that:

(a) when the measured saturated pressure is less than a first level for use of vapor by the application, the first vapor flow path is closed and the second vapor flow path is opened;

(b) when the measured saturated pressure is equal to or greater than the first level and less than a second level, the first vapor flow path is opened and the second vapor flow path is opened; and (c) when the measured saturated pressure is equal to or greater than the second level, the first vapor flow path is opened and the second vapor flow path is closed; and C) agitating the storage tank to raise the saturated pressure of the cryogenic liquid in the storage tank to the second level, wherein the storage tank is agitated by operating the transport vehicle.

2. The method according to claim 1, wherein the piping system includes exactly one liquid flow path.

3. The method according to claim 1, wherein the piping system includes exactly one first vapor flow path.

4. The method according to claim 1, wherein the piping system includes exactly one second vapor flow path.

5. The method according to claim 1, wherein the at least one valve for selectively opening and closing the first vapor path and the second vapor path comprises a first valve in the first vapor path and a second valve in the second vapor path.

6. The method according to claim 1, wherein the liquid flow path includes means for maintaining a definitive liquid level within the piping system.

7. The method according to claim 6, wherein the means for maintaining a definitive liquid level within the piping system comprises a trap.

8. The method according to claim 6, wherein the means for maintaining a definitive liquid level within the piping system comprises a valve.

* * * * *